US010906563B2

(12) United States Patent
Behrendt et al.

(10) Patent No.: US 10,906,563 B2
(45) Date of Patent: Feb. 2, 2021

(54) CAR BODY FOR A PASSENGER RAIL VEHICLE

(71) Applicant: SIEMENS AG OESTERREICH, Vienna (AT)

(72) Inventors: Lars Behrendt, Vienna (AT); Andreas Niederstaetter, Graz (AT); Josef Wiesinger, Gaweinstal (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 242 days.

(21) Appl. No.: 15/999,272

(22) PCT Filed: Feb. 15, 2017

(86) PCT No.: PCT/EP2017/053384
§ 371 (c)(1),
(2) Date: Sep. 12, 2018

(87) PCT Pub. No.: WO2017/140717
PCT Pub. Date: Aug. 24, 2017

(65) Prior Publication Data

US 2019/0106129 A1 Apr. 11, 2019

(30) Foreign Application Priority Data

Feb. 17, 2016 (AT) ..... 50105/2016

(51) Int. Cl.
*B61D 17/10* (2006.01)
*B61F 1/00* (2006.01)

(52) U.S. Cl.
CPC ..... *B61D 17/10* (2013.01); *B61F 1/00* (2013.01)

(58) Field of Classification Search
CPC ..... B61D 17/10; B61D 17/041; B61D 17/00; B61F 1/00; B61F 1/10
See application file for complete search history.

(56) References Cited

U.S. PATENT DOCUMENTS 5,388,529 A * 2/1995 Tieberghien ..... B61D 17/04 105/397
2015/0047530 A1 2/2015 Hirashima et al.

FOREIGN PATENT DOCUMENTS

| | | |
|---|---|---|
| CN | 201516856 | 6/2010 |
| CN | 201516856 U | 6/2010 |
| CN | 201580395 U | 9/2010 |
| CN | 104354711 | 2/2015 |
| CN | 204956497 U | 1/2016 |
| DE | 4008703 | 9/1991 |

(Continued)

*Primary Examiner* — Mark T Le
(74) *Attorney, Agent, or Firm* — Cozen O'Connor

(57) ABSTRACT

A car body for a passenger rail vehicle includes a chassis having a front assembly at each vehicle end and a vehicle floor consisting of profiled metal sheet edged in a trapezoidal-like manner within the cross-section, wherein beads of the profiled metal sheet extend in a longitudinal direction of the car body, where the vehicle floor is fixedly connected to each front assembly at transition points to the front assembly via a connecting beam oriented transversely to the longitudinal direction of the car body, where the connecting beam is formed as a profiled metal sheet having a substantially L-shaped cross-section, and where the section of the connecting beam connected to a front assembly is equipped with a trapezoidal-like bead.

10 Claims, 2 Drawing Sheets

(56) References Cited

FOREIGN PATENT DOCUMENTS

| | | |
|---|---|---|
| JP | H05254429 | 10/1993 |
| JP | 2002067938 | 3/2002 |
| JP | 2017-144911 | 8/2017 |
| WO | WO2012136500 | 10/2012 |
| WO | WO2012136514 | 10/2012 |

* cited by examiner

CAR BODY FOR A PASSENGER RAIL VEHICLE

CROSS-REFERENCE TO RELATED APPLICATIONS

This is a U.S. national stage of application No. PCT/EP2017/053384 filed Feb. 15, 2017. Priority is claimed on AT Application No. A50105/2016 filed Feb. 17, 2016, the content of which is incorporated herein by reference in its entirety.

BACKGROUND OF THE INVENTION

1. Field of the Invention

The invention relates to a car body for a passenger rail vehicle.

2. Description of the Related Art

Rail vehicles, in particular passenger rail vehicles, are currently manufactured in most instances as self-supporting metal structures. Here, a vehicle body is assembled from a chassis, front walls and a roof. The chassis must withstand operating forces, particularly the loading, coupling pressure and tensile forces. To this end, the chassis is frequently designed as a frame structure and typically comprises two external longitudinal beams and possibly a central longitudinal beam as well as a number of transverse beams connecting the longitudinal beams and is reinforced at the vehicle ends. This reinforcement is accomplished via what are known as end pieces at the vehicle end and main transverse beams, which also comprise the bearings of the pivoted bogies (or individual axes). To license rail vehicles, it is necessary to fulfil specific standards that often vary from country to country. These standards require inter alia the proof that the rail vehicle can withstand a specific longitudinal force (clutch pressure) without incurring damage.

The International Union of Railways (UIC) standard 566, valid for Europe, requires a proven clutch pressure of 2000 kN, where the standard valid for the USA requires 3560 kN. With these forces, which lie far above the longitudinal compressive forces occurring during operation, elastic deformations of the car body occur. These deformations cause voltage peaks in the various components, so that respect must be given to an accurate design of the structure. These voltage peaks can result in the failure of welded seams, or in the breakage of relevant components particularly on components in the transition between the front assembly and the chassis. It is possible to design these components with an essentially thicker wall thickness, but this increases the vehicle weight.

SUMMARY OF THE INVENTION

In view of the foregoing, it is an object of the invention to provide a car body for a passenger rail vehicle which, even with high axial compressive forces, only has minimal voltage peaks on components of the chassis, particularly at the transition between the vehicle floor in the front assembly.

This and other objects and advantages are achieved in accordance with the invention by a car body for a passenger rail vehicle, comprising a chassis with, in each case, a front assembly at each vehicle end and a vehicle floor consisting of profiled metal sheet edged in a trapezoidal-like manner in the cross-section, where the beads of the profiled metal sheet extend in the longitudinal direction of the car body, where the vehicle floor is fixedly connected at transition points to each one of the front assemblies via a connecting beam, at the respective front assembly, oriented transversely to the longitudinal direction of the car body, where the connecting beam is formed as a profiled metal sheet having a substantially L-shaped cross-section, and where the section of the connecting beam connected to a front assembly is equipped with a trapezoidal-like bead.

As a result, it becomes possible to advantageously establish a connection between a vehicle floor and a front assembly which, even at very high longitudinal compressive forces, reduces the voltage peaks at the fastening points with the front assembly to substantially lower values than is possible with solutions known from the prior art.

Longitudinal compressive forces, which act on a car body by way of the centre buffer clutches, require a deformation of the car body. Here, the end region (front assembly) which is designed to be very solid is deformed substantially less significantly than the centre region of the car body which is designed to be softer in comparison. The transition between the minimally deformed end region and the deformed centre region of a vehicle body is particularly critical, because it is at this point that the highest voltage peaks occur.

Car bodies of rail vehicles are frequently manufactured with a vehicle floor made from a trapezoidal sheet, on which a passenger compartment floor is attached. In the cavities produced by the trapezoidal shape, water, which is to be discharged, can form as a result of condensation. This discharge of water must occur through the smallest possible openings, because otherwise the pressure tightness properties are compromised. It is therefore usual to complete the vehicle floor (the trapezoidal sheet) with a connecting beam and to connect the same to the front assembly, and to provide one or more water outlet openings on the connecting beam.

The connecting beam is formed substantially with an L-shaped cross-section and is fastened to the vehicle floor and the front assembly via welded connections.

These welded connections, in particular the welded connection with the front assembly is subjected to particularly high constraining forces during the deformation of the car body such that their stability may be jeopardized.

In accordance with the invention, a connecting beam is therefore provided, which has a high elasticity so that the constraining forces are significantly reduced on account of the deformation of the vehicle body. Thus, both the main dimensions, and also the wall thicknesses and materials of the connecting beam can be retained.

The connecting beam is equipped with a feature that increases elasticity on the side facing the front assembly, the corresponding limb of the L-shaped cross-section. Here, this section is formed with a trapezoidal bead, such that the resistance torque of the connecting beam is significantly reduced.

In accordance with a preferred embodiment of the invention, the connecting beam is equipped with cut-outs, through which a section of the vehicle floor can be passed. As a result, a particularly fixed connection can be established with the vehicle floor, because the length of the welded seam connecting the connecting beam to the vehicle floor is increased.

It is advantageous to equip the connecting beam with at least one water outlet borehole, so that the water collecting in the cavities of the vehicle floor can drain off.

An inventive car body can be produced in two ways. In one embodiment, the connecting beam can be assembled from several individual sheets which are welded to one another.

In a second embodiment, the production of the connecting beam is performed using a deformation method comprising a single sheet (in one piece).

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

By way of example.

DETAILED DESCRIPTION OF THE EXEMPLARY EMBODIMENTS

Figure 1:
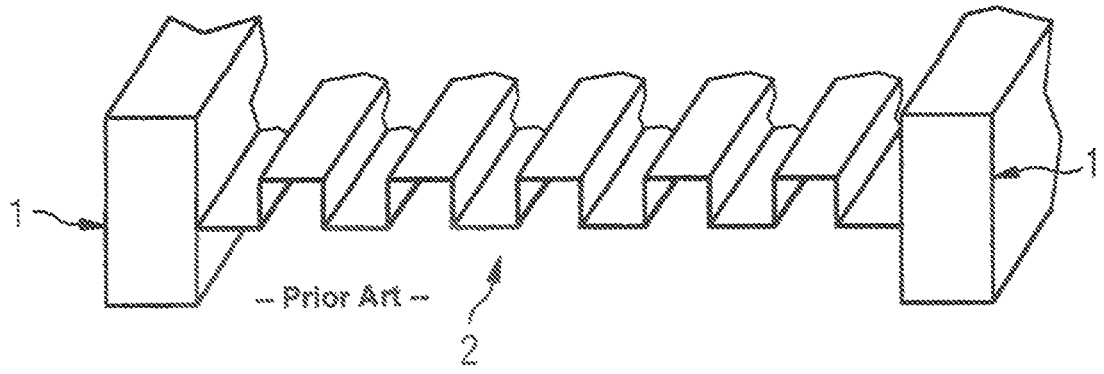
FIG. 1 shows the cross-section through a vehicle floor.

FIG. 1 shows, by way of example and schematically, a cross-section through a vehicle floor. A cut at right angles to the longitudinal direction of a rail vehicle is shown, where for simplification further components, such as a central longitudinal beam or a transverse beam, are not shown. The chassis of the vehicle comprises two external longitudinal beams 1, between which a vehicle floor 2 is arranged. The vehicle floor 2 is typically welded with the longitudinal beams and is formed as what is known as a trapezoidal sheet. This trapezoidal sheet consists of an edged sheet, which is trapezoidal cross-sectionally, where the beads of the profiled metal sheet extend in the longitudinal direction of the car body.

Figure 2:
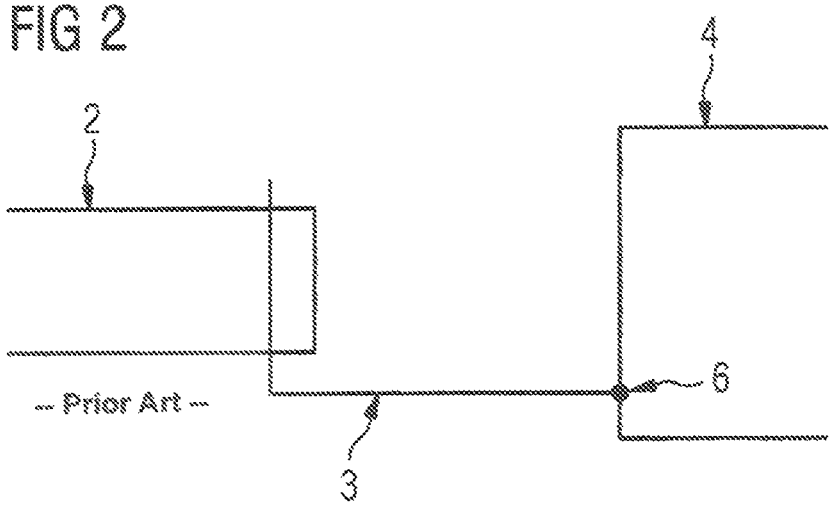
FIG. 2 shows a vehicle floor, transition with a front assembly and a conventional connecting beam.

FIG. 2 shows, by way of example and schematically, a vehicle floor at the point of the transition with a front assembly and a conventional connecting beam in accordance with the prior art. Here, a cut along the longitudinal direction of a rail vehicle through the chassis is shown. The vehicle floor 2 comprises trapezoidal sheet ends at this transition point and is connected to the front assembly 4 of the vehicle. To this end, a connecting beam 3 of a conventional design is provided oriented at right angles to the vehicle longitudinal axis, which substantially has an L-shaped cross-section and which is fixedly and non-detachably connected both with the vehicle floor 2 and also with the front assembly 6, typically using welded connections. The connecting beam 3 in accordance with the conventional design is provided with cut-outs, which allow for the vehicle body 2 to pass/extend at least partially through a section of the connecting beam 3, so that a welded connection can be established with high stability at this connecting point. The welded seam 6 for connecting the connecting beam 3 with the front assembly 4 is subject to very high loads, because with high axial loads the front assembly 6 twists relative to the vehicle floor 2. The smaller wall thickness of the connecting beam 3, compared with the front assembly 4, also increases the failure probability of the welded seam 6.

Figure 3:
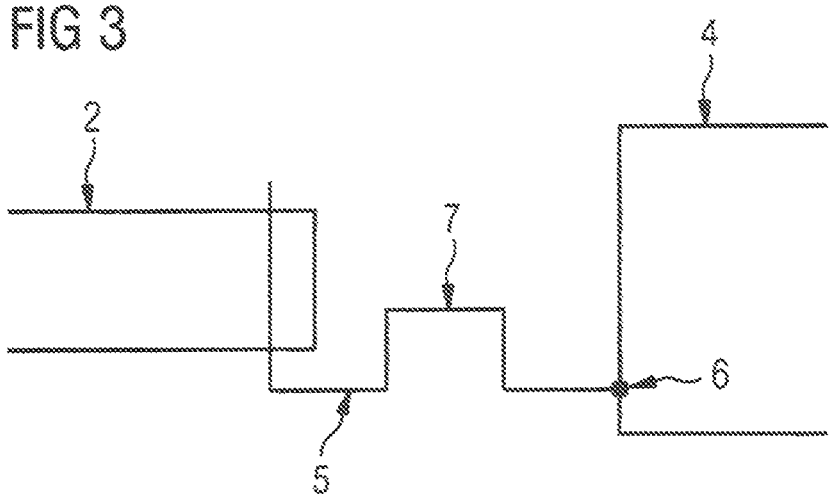
FIG. 3 shows a vehicle floor, transition with a front assembly and a connecting beam.

FIG. 3 shows, by way of example and schematically, a vehicle floor at the point of the transition between a front assembly and a connecting beam. The transition point from FIG. 2 is shown, where an inventive connecting beam 5 is however inserted between the vehicle floor 2 and the front assembly 4. This connecting beam 5 is equipped with a beam 7 of a trapezoidal shape. This beam reduces the resistance torque of the connecting beam against deformations due to the introduction of torque at high axial loads, so that the connecting beam 5 can be deformed more easily and the load of the welded seam 6 is significantly reduced.

Figure 4:
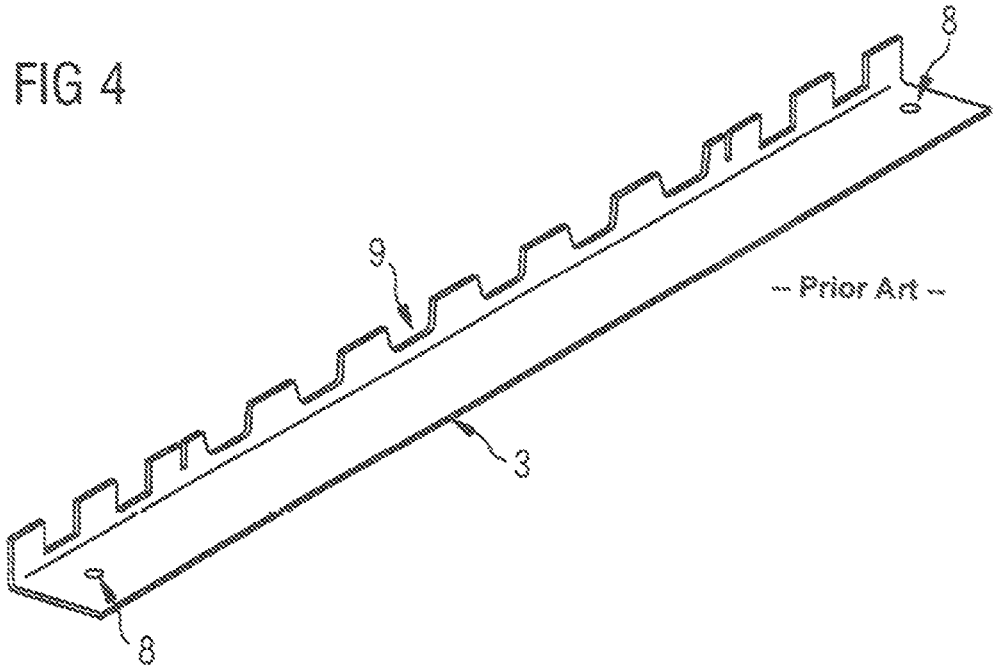
FIG. 4 shows conventional connecting beams.

FIG. 4 shows, by way of example and schematically, a conventional connecting beam. It shows an oblique view of a connecting beam 3, as can be used for instance in an application shown in FIG. 2. The connecting beam 3 has a substantially L-shaped cross-section, where a section is equipped with cut-outs 9. Furthermore, the connecting beam 3 comprises two water outlet boreholes 8.

Figure 5:
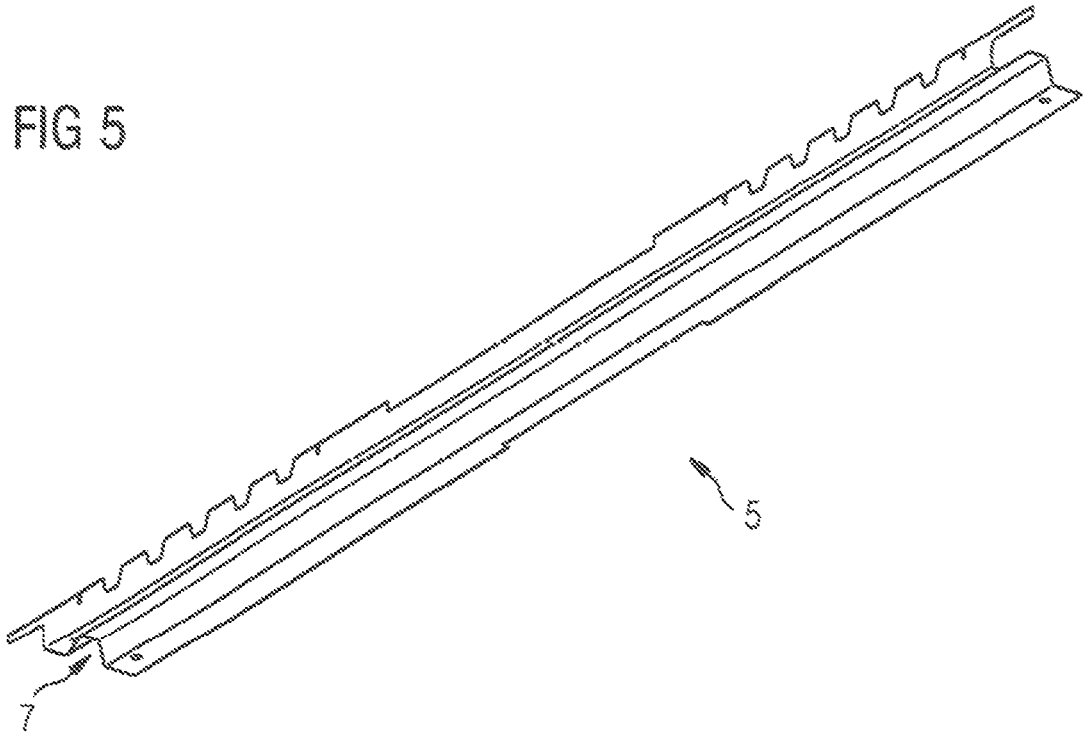
FIG. 5 shows a connecting beam.

FIG. 5 shows, by way of example and schematically, a connecting beam. It shows an oblique view onto an inventive connecting beam 5, as can be used for instance in an application shown in FIG. 3. The connecting beam 5 has a substantially L-shaped cross-section, where a section is equipped with cut-outs 9. The second section of the connecting beam 5 is designed with a trapezoidal bead 7.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A car body for a passenger rail vehicle, comprising:

a chassis having a front assembly at each respective vehicle end; and a vehicle floor consisting of profiled metal sheet having trapezoidally-shaped beads, when viewed cross-sectionally, the beads of the profiled metal sheet extending in a longitudinal direction of the car body;

wherein the vehicle floor is fixedly connected to each front assembly at transition points to said front assembly via a connecting beam oriented transversely to the longitudinal direction of the car body;

wherein the connecting beam is formed as a profiled metal sheet having a substantially L-shaped cross-section; and wherein a section of the connecting beam connected to a front assembly includes a trapezoidally-shaped beam having two non-parallel sides connected to a top side.

2. The car body for a passenger rail vehicle according to claim 1, wherein the connecting beam has cut-outs, through which a section of the vehicle floor extends.

3. The car body for a passenger rail vehicle according to claim 1, wherein the connecting beam has at least one water outlet borehole.

4. The car body for a passenger rail vehicle according to claim 2, wherein the connecting beam has at least one water outlet borehole.

5. The car body for a passenger rail vehicle according to claim 1, wherein the connecting beam is assembled from a number of individual metal sheets welded together.

6. The car body for a passenger rail vehicle according to claim 2, wherein the connecting beam is assembled from a number of individual metal sheets welded together.

7. The car body for a passenger rail vehicle according to claim 3, wherein the connecting beam is assembled from a number of individual metal sheets welded together.

8. The car body for a passenger rail vehicle according to claim 1, wherein the connecting beam is produced in one piece from an individual metal sheet via a deformation method.

9. The car body for a passenger rail vehicle according to claim 2, wherein the connecting beam is produced in one piece from an individual metal sheet via a deformation method.

10. The car body for a passenger rail vehicle according to claim 3, wherein the connecting beam is produced in one piece from an individual metal sheet via a deformation method.

* * * * *